US006902080B2

(12) United States Patent
Busch

(10) Patent No.: US 6,902,080 B2
(45) Date of Patent: Jun. 7, 2005

(54) LOCKING CONTAINER

(75) Inventor: Craig William Wayne Busch, Barrie (CA)

(73) Assignee: Busch Systems International, Inc., Barrie (CA)

( * ) Notice: Subject to any disclaimer, the term of this patent is extended or adjusted under 35 U.S.C. 154(b) by 42 days.

(21) Appl. No.: 10/417,382

(22) Filed: Apr. 16, 2003

(65) Prior Publication Data

US 2004/0206759 A1 Oct. 21, 2004

(51) Int. Cl.[7] ..... B65D 45/00; B65D 55/14

(52) U.S. Cl. ..... 220/315; 220/908; 220/210; 220/833; 70/159; 70/164; 292/DIG. 11; 292/DIG. 38

(58) Field of Search ..... 220/318, 324, 220/833, 835, 908, 210, 315; 70/2, 172, 159–162, 164, 168; 292/289, 295, 298, 300, 302, DIG. 38, 148, 283, 292, DIG. 11

(56) References Cited

U.S. PATENT DOCUMENTS 429,795 A * 6/1890 Pusey ..... 70/80
1,168,066 A * 1/1916 Girardot ..... 70/447
3,606,423 A * 9/1971 McCarthy ..... 292/148
3,727,438 A * 4/1973 Knaack ..... 70/63
3,831,383 A * 8/1974 Crank ..... 405/264
4,031,722 A * 6/1977 Michelman et al. ..... 70/63
4,290,281 A * 9/1981 Knaack et al. ..... 70/54
4,319,762 A * 3/1982 Streit et al. ..... 280/79.2
4,371,092 A * 2/1983 Teague ..... 220/324
5,036,999 A * 8/1991 Bitsch ..... 220/627
5,149,153 A * 9/1992 Drewry et al. ..... 292/104
5,224,744 A 7/1993 Michelutti
5,272,832 A * 12/1993 Marshall et al. ..... 43/131
5,293,990 A * 3/1994 Masakayan ..... 206/1.5
5,328,049 A * 7/1994 Ritzow ..... 220/315
5,419,598 A * 5/1995 Kreitzer ..... 292/230
5,738,395 A 4/1998 Probst
5,845,521 A * 12/1998 Najera ..... 70/56
6,290,093 B1 9/2001 Obriot et al.
6,332,554 B1 * 12/2001 McCarthy ..... 220/554
6,670,879 B2 * 12/2003 Carter et al. ..... 336/90
6,733,053 B2 * 5/2004 Hodge et al. ..... 292/336.3

* cited by examiner

*Primary Examiner*—Lee Young
*Assistant Examiner*—James Smalley
(74) *Attorney, Agent, or Firm*—Barnes & Thornburg LLP

(57) ABSTRACT

A lockable container particularly suitable for storing confidential documents or recyclable material has a locking system provided by an elongate tongue that projects downwardly from the underside of the front of a hinged lid and passes through a slot in the material of the upper front wall so that in the closed position of the lid the tongue lies closely behind and is shielded by an apron that extends transversely across the upper end of the front wall of the container. Holes provided in the lower end of the tongue and near the bottom of the apron are brought into alignment when the lid is closed so that the lid can be locked in the closed position by a padlock with a hasp passed through the aligned apertures.

6 Claims, 3 Drawing Sheets

LOCKING CONTAINER

BACKGROUND OF THE INVENTION a) Field of the Invention

This invention relates to a container having new or improved locking system for securing the lid of the container, and is particularly applicable to the means for securing and locking closed the lid of a container for receiving waste or recyclable material.

b) Description of the Prior Art

In the past numerous containers with lockable lids have been designed for different purposes, and there are several examples of such containers designed for waste disposal applications.

U.S. Pat. No. 5,224,744 Michelutti discloses a wheeled waste container useful for the mechanized collection of household waste and including a container lock that is key-operated and is positioned in the front upper wall of the container, the lock including a cam which controls movement of a locking piece that is adapted to engage a catch projecting from the underside of the lid.

U.S. Pat. No. 5,738,395 Probst shows a dumpable rubbish container with a latch arrangement that is effective to prevent opening of the lid by high winds or by animals, the latch being self-releasing when the container is tilted towards and into the dumping position.

U.S. Pat. No. 6,290,093 Obriot et al. shows a garbage container that includes a lid lock mechanism which is unlocked by the force of gravity when the container is inverted for dumping, but which can also be released by a key when a container is in its normal upright position.

Other prior art locking mechanisms for lidded containers include arrangements wherein a short rigid tang extending downwardly from the lid is received in the upper edge of the container wall and is engaged by a key controlled lock. Also known is an arrangement wherein such a tang is positioned on the upper edge of the wall of the container to pass through a slot in the lid when the container is closed and be engaged above the lid by a padlock or the like to lock the lid closed.

It is particularly desirable to provide locking arrangements on containers for recyclable materials such as bottles, aluminum cans, etc. since these items have value and might therefore be the subject of theft and the destruction of confidential paper documents since they contain sensitive or confidential information. The locking container disclosed herein is designed for use primarily in such an application.

SUMMARY OF THE INVENTION

The invention provides a container comprising an open-topped body defined by an arrangement of upright walls, and a lid sized to close the top of the body, a rear portion of the lid being pivotally attached to a rear portion of the body; a transverse apron attached to an upper edge of a front wall portion of the body and spaced forwardly therefrom, said apron extending downwardly to a lower edge and having an aperture therein close to the lower edge; a slot formed in said upper edge of the front wall portion; an elongate locking tongue mounted on a front portion of said lid at a location corresponding to said slot, said tongue extending downwardly from the lid such that when the lid is moved to a closed position the tongue can be passed through said slot to lie behind said apron, said tongue having a length corresponding to the height of said apron and containing an aperture near its lower end positioned to be in alignment with the aperture in said apron when the lid is closed, such that the lid can be secured in the closed position by a retainer passed through the aligned apertures.

The retainer can be any suitable type of blocking member. It is particularly convenient to provide a padlock to lock the lid closed, the curved hasp of the padlock being easily threaded through the aligned apertures.

The apron can be integrally molded with the body of the container, typically such containers being fabricated in plastics material such as High Density polyethylene and the like. Although generally stiff and inextensible, the tongue preferably is able to move somewhat at its free end so that the latter can readily be guided into and through the slot as the lid moves towards the closed position.

In one embodiment the tongue is a plastic molding having an enlarged head at its upper end, the head being positioned against the upper side of the lid and the tongue extending through the lid and being secured thereto by any suitable means. For example the lid may be provided with a slot through which the tongue extends, the tongue having a detent tooth adjacent its head. When the tongue is installed on the lid the tooth can be passed through the slot in the lid by flexure of the material, and having passed through the slot creates a blocking interference preventing removal of the tongue from the lid.

To secure the lid in the closed and locked position, a padlock can be employed, the U-shaped hasp of the padlock being threaded through the aligned apertures of the tongue and apron and then locked. In the locked position the length of the tongue is completely hidden behind the apron and therefore cannot be accessed by a would-be thief.

BRIEF DESCRIPTION OF THE DRAWINGS

The invention will further be described, by way of example only, with reference to the accompanying drawings wherein.

DESCRIPTION OF THE PREFERRED EMBODIMENT

Figure 1:
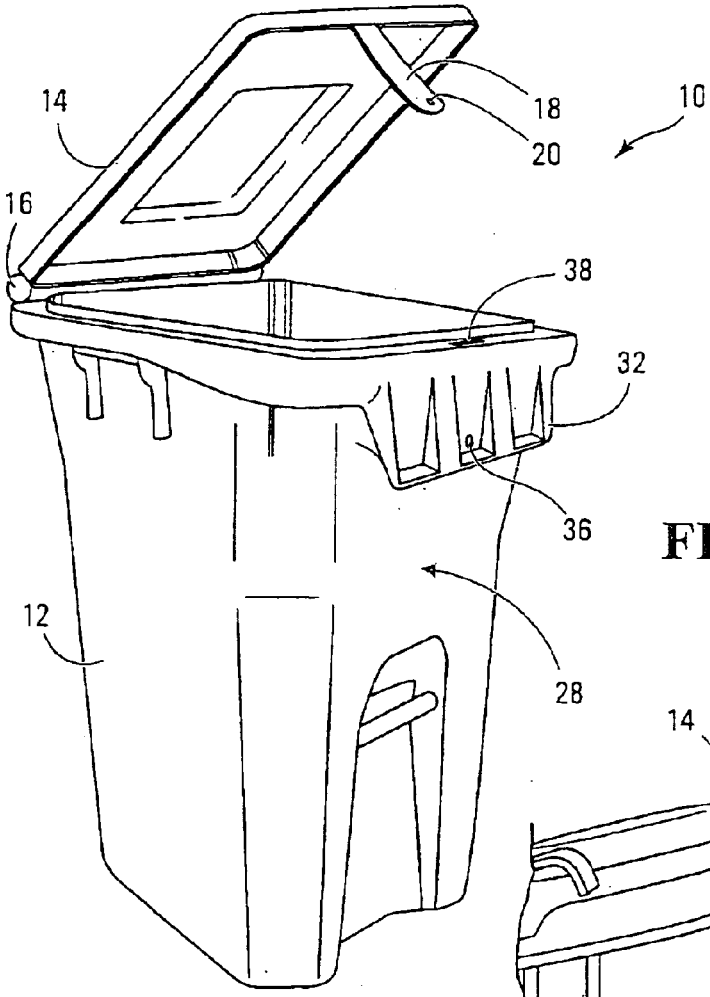
FIG. 1 is a perspective view of a lidded waste container shown with the lid in partially open position.

The container 10 shown in FIG. 1 comprises an open-topped body 11 and a lid 14 that is pivotally attached to the rear side of the body by a hinge 16.

Figure 5:
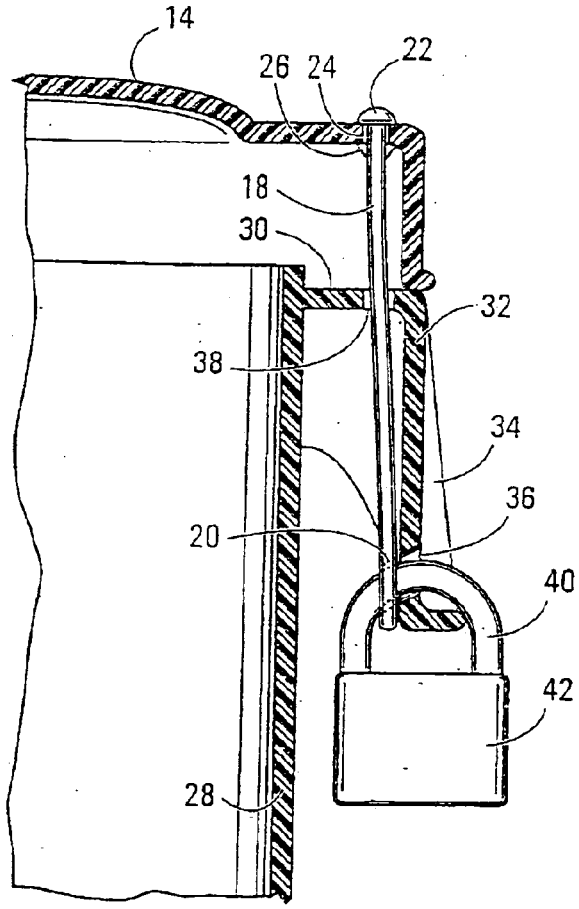
FIG. 5 is a fragmentary sectional view to an enlarged scale taken on the line V—V in FIG. 4.
Figure 6:
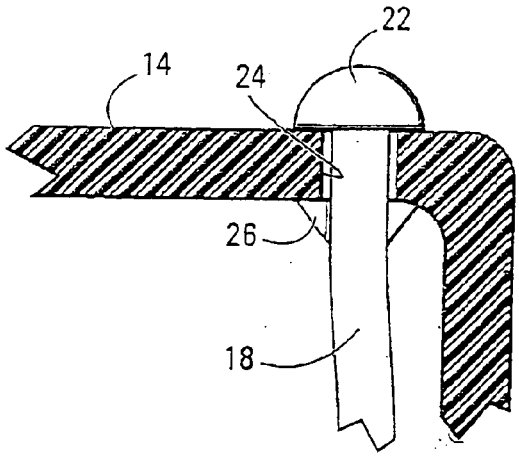
FIG. 6 is an enlarged detail of FIG. 5.

As seen particularly in FIGS. 1, 5 and 6 at the front of the lid there is mounted a downwardly extending elongate tongue 18 having a hole 20 in the vicinity of its free end. The tongue has an enlarged head positioned snugly against the upper side of the lid and passes through a slot 24 in the lid, the tongue being secured to the lid with respect to this slot. Specifically, adjacent its head the tongue has laterally projecting teeth 26. The tongue is assembled to the lid by being passed longitudinally therethrough until the head 22 comes into contact with the upper surface of the lid 14. The slot 24 is only slightly wider than the thickness of the tongue 18 so that as the installed position is neared, the ramp shaped teeth 26 must be passed through the slot 24, this being achieved by resilient flexure of the material of the lid 14 and/or the teeth 26, so that when the teeth have passed completely through the slot 24, they are restored to their outwardly projecting positions overlapping the lid material at the edge of the slot 24 as seen in FIG. 6 and thus securing the tongue against withdrawal.

Figure 2:
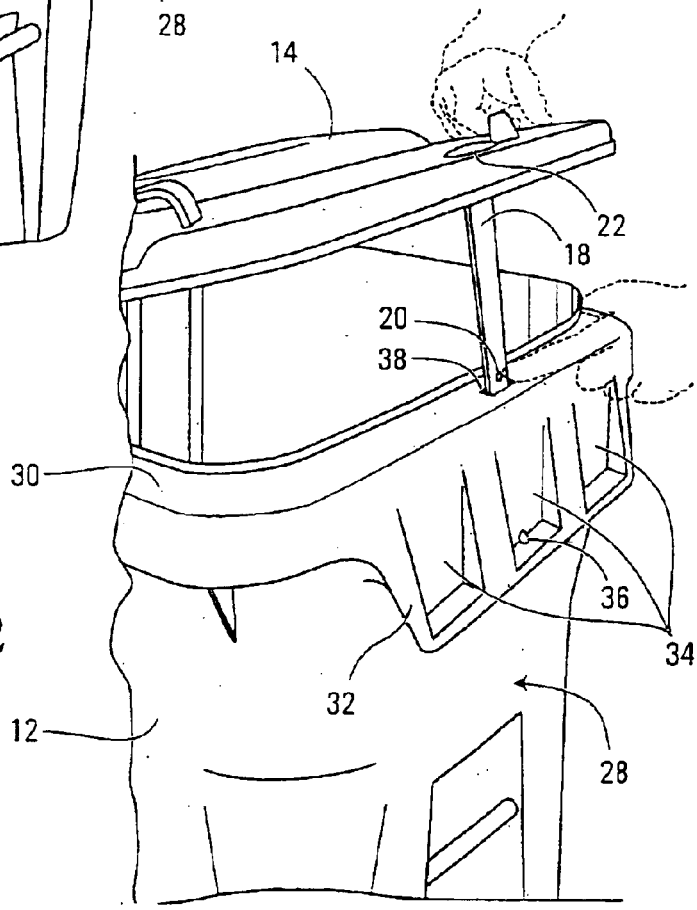
FIG. 2 is a fragmentary perspective view to a larger scale showing the lid being moved towards the closed position.
Figure 3:
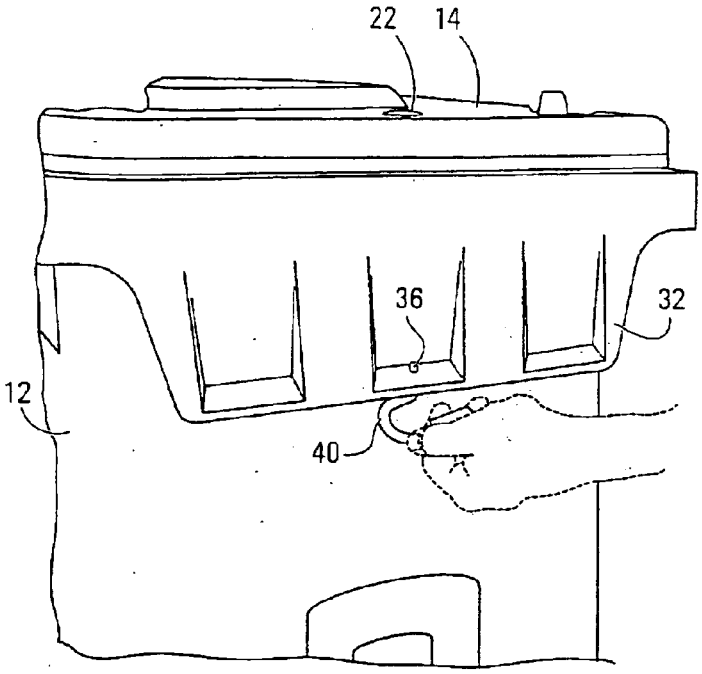
FIG. 3 is a perspective view showing the manner of locking the lid in closed position.
Figure 4:
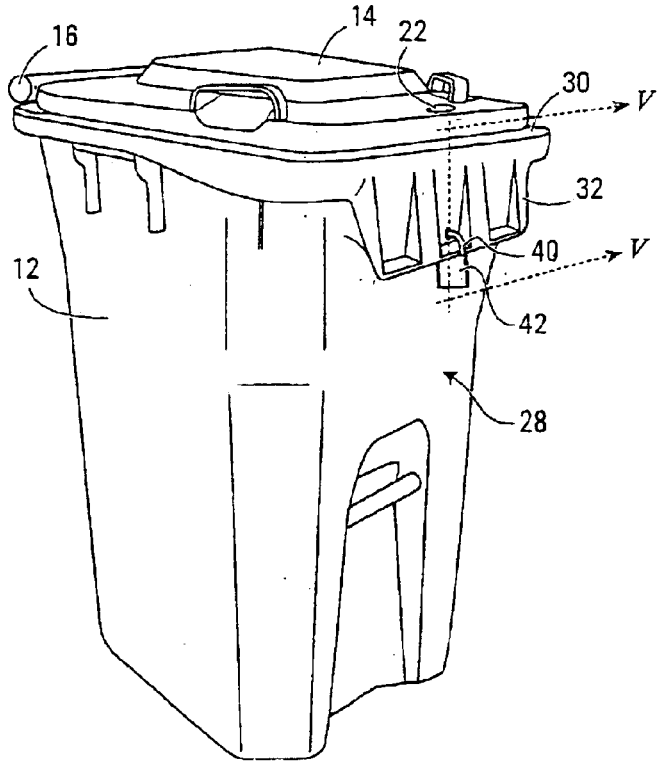
FIG. 4 is a perspective view of the container shown with the lid closed and locked.

As best seen in FIGS. 1, 2 and 5, the front wall 28 of the container has an integral forwardly projecting horizontal extension 30 which in turn supports a downwardly extending apron 32 which has a transverse width that is slightly less than the width of the front wall 28 and has a substantial height in the vertical direction, three transversely spaced wedge-shaped depressions 34 in the apron serving to provide a good degree of stiffness to the apron despite the relatively small thickness of its material. Near the lower end of the central one of the depressions there is an aperture 36 through the apron.

A transversely elongate slot 38 is provided in the horizontal extension 30 of the front wall, this slot being sized to receive with clearance the tongue 18 which accordingly is guided into and passed through the slot 38 as the lid is moved to the closed position.

In the closed position the tongue 18 extends downwardly immediately behind the apron 32 (FIG. 5) 50 that the hole 20 in the tongue registers with the aperture 36 in the apron 32 as best seen in FIG. 5. In this position the U-shaped hasp 40 of a padlock 42 can be threaded from behind the apron through the registering apertures 20 and 36 and the padlock secured to lock the lid in the closed position.

Thus the present invention provides for the use of a simple inexpensive padlock to secure the lid closed, in contrast to more expensive special purpose locking mechanisms that have been employed in the prior art. Furthermore the locking arrangement is neat in appearance in that the tongue is hidden behind the apron 32 and therefore does not lend itself to tampering. While no system can ever be entirely theft-proof, the locking system described above and disclosed in the accompanying drawings is not readily bypassed or disabled but rather provides a secure means of locking the lid in the closed position.

It will be apparent that the tongue arrangement can be secured to the lid in ways other than that disclosed in FIG. 5. For example the tongue could be designed with a flange (not shown) at its upper end, this flange being secured to the underside of the lid by welding, riveting or the like. Whatever arrangement of tongue is used it is important that either through its own resilience or through some degree of play in its attachment to the lid, the lower end of the tongue can be moved slightly by hand to ensure that it always enters smoothly into the elongate slot 38 when the container is being closed.

Depending on the nature of the recyclable material that is intended to be received in the container, the lid of the container will have an appropriate formation which may for example be slot-shaped for receiving paper and cardboard or round for receiving bottle, cans or the like.

While specific details of the invention are disclosed and described above in relation to the illustrated embodiment, it will be recognised that modifications and variations may readily occur to those skilled in the art, and consequently it is intended that all such modification and equivalents lie within the scope of the claims that are appended hereto.

What is claimed is:

1. A container comprising an open-topped body defined by an arrangement of upright walls, and a lid sized to close the top of the body, a rear portion of the lid being pivotally attached to a rear portion of the body; a transverse apron attached to an upper edge of a front wall portion of the body and spaced forwardly therefrom, said apron extending downwardly to a lower edge and having an aperture defined therein close to the lower edge; a slot formed in said upper edge of the front wall portion; an elongate locking tongue mounted on a front portion of said lid at a location corresponding to said slot, said tongue extending downwardly from the lid such that when the lid is moved to a closed position the tongue can be passed through said slot to lie behind said apron, said tongue having a length corresponding to the height of said apron and containing an aperture near its lower end positioned to be in alignment with the aperture in said apron when the lid is closed, such that the lid can be secured in the closed position by a retainer passed through the aligned apertures.

2. A container as claimed in claim 1 wherein said apron is integrally moulded with the body.

3. A container as claimed in claim 1 wherein said tongue is flexible such that it can readily be guided into and through said slot as the lid is moved towards the closed position.

4. A container as claimed in claim 1 wherein said tongue is a plastic moulding having an enlarged head at its upper end and a laterally projecting detent positioned at a slight spacing from said head, said spacing corresponding to the thickness of said lid and said detent providing on one side a ramp which enables the detent to be passed through a slot in the lid through resilient flexure of material until the detent passes completely through the lid whereupon a blocking interference is created between said slot and said detent.

5. A container as claimed in claim 1 wherein said apertures are sized to receive the hasp of a padlock which can be looped therethrough to lock the container in closed condition.

6. A container as claimed in claim 1 wherein said lid is formed with an opening that is sized to allow the passage therethrough of selected recyclable material.

* * * * *